US012745828B2

(12) United States Patent
Purnell et al.

(10) Patent No.: US 12,745,828 B2
(45) Date of Patent: Sep. 29, 2026

(54) HAIRCARE APPLIANCE

(71) Applicant: Dyson Technology Limited, Wiltshire (GB)

(72) Inventors: Thomas Christopher Purnell, Swindon (GB); Ayrton Lloyd Taylor Peel, Gloucester (GB); David Andrew Tibbetts, Bristol (GB); Stephen Benjamin Courtney, Gloucester (GB); Robert Mark Brett Coulton, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 267 days.

(21) Appl. No.: 18/533,128

(22) Filed: Dec. 7, 2023

(65) Prior Publication Data

US 2024/0108115 A1 Apr. 4, 2024

Related U.S. Application Data

(63) Continuation of application No. 18/273,731, filed as application No. PCT/GB2022/050012 on Jan. 6, 2022, now Pat. No. 12,274,342.

(30) Foreign Application Priority Data

Jan. 29, 2021 (GB) ..... 2101265

(51) Int. Cl.
*A45D 20/50* (2006.01)
*A45D 20/12* (2006.01)

(52) U.S. Cl.
CPC ..... *A45D 20/50* (2013.01); *A45D 20/124* (2013.01)

(58) Field of Classification Search
CPC ..... A45D 20/50; A45D 20/124; A45D 20/12; A45D 20/122; A45D 20/10
(Continued)

(56) References Cited

U.S. PATENT DOCUMENTS 3,939,850 A 2/1976 Wahl
8,959,788 B2 2/2015 Hada
(Continued)

FOREIGN PATENT DOCUMENTS

CA 2083086 A1 5/1994
CN 103519540 A 1/2014
(Continued)

OTHER PUBLICATIONS

Examination Report received for GB Application No. 2101272.9, mailed on Jun. 23, 2023, 1 page.
(Continued)

*Primary Examiner* — John P Mccormack
(74) *Attorney, Agent, or Firm* — Tucker Ellis LLP

(57) ABSTRACT

A haircare appliance having an air inlet, an air outlet, and an airflow generator for generating an airflow from the air inlet to the air outlet and an attachment for a haircare appliance, the attachment including an air inlet, an air outlet. A curved surface adjacent to and downstream of the air outlet. The haircare appliance or the attachment has a curved surface adjacent to and downstream of the air outlet. The haircare appliance or the attachment is configured such that airflow exiting the air outlet generates a first force to attract hair toward the curved surface, and a second force to push hair away from the curved surface.

21 Claims, 9 Drawing Sheets

(58) Field of Classification Search
USPC ..... 132/271; 34/96
See application file for complete search history.

(56) References Cited

U.S. PATENT DOCUMENTS

| | | | | |
|---|---|---|---|---|
| 9,713,370 | B2 | 7/2017 | Thomason et al. | |
| 10,856,638 | B2 | 12/2020 | Paliobeis et al. | |
| 2002/0112362 | A1 | 8/2002 | Correa et al. | |
| 2013/0111777 | A1 | 5/2013 | Jeong | |
| 2014/0007448 | A1 | 1/2014 | Courtney et al. | |
| 2015/0265022 | A1 | 9/2015 | Maclaine | |
| 2015/0265023 | A1* | 9/2015 | Maclaine | A45D 20/50 132/212 |
| 2015/0265024 | A1 | 9/2015 | Maclaine | |
| 2016/0100681 | A1 | 4/2016 | Smal | |
| 2017/0273423 | A1* | 9/2017 | Mason | A45D 20/00 |
| 2017/0273430 | A1 | 9/2017 | Heffer et al. | |
| 2019/0357654 | A1* | 11/2019 | MacPherson | A45D 20/12 |
| 2021/0007458 | A1 | 1/2021 | Nilsen | |
| 2021/0289909 | A1 | 9/2021 | Kirkbride et al. | |
| 2021/0307472 | A1 | 10/2021 | Conrad | |
| 2022/0408895 | A1 | 12/2022 | Lelieveld | |
| 2023/0284762 | A1 | 9/2023 | Sarbashev | |
| 2024/0008618 | A1 | 1/2024 | Coulton et al. | |
| 2024/0374010 | A1* | 11/2024 | Fedorov | A45D 20/12 |

FOREIGN PATENT DOCUMENTS

| | | | |
|---|---|---|---|
| CN | 104055306 | A | 9/2014 |
| CN | 104921436 | A | 9/2015 |
| CN | 106287993 | A | 1/2017 |
| CN | 107224081 | A | 10/2017 |
| CN | 107224084 | A | 10/2017 |
| CN | 107259761 | A | 10/2017 |
| CN | 110731595 | A | 1/2020 |
| CN | 210747801 | U | 6/2020 |
| CN | 111887565 | A | 11/2020 |
| CN | 112273833 | A | 1/2021 |
| CN | 111248594 | B | 5/2023 |
| DE | 19836157 | A1 | 2/2000 |
| DE | 202020003366 | U1 | 8/2020 |
| DE | 202020003367 | U1 | 8/2020 |
| DE | 202020003368 | U1 | 8/2020 |
| DE | 202020003369 | U1 | 8/2020 |
| EP | 3834654 | A1 | 6/2021 |
| FR | 2743252 | A1 | 7/1997 |
| GB | 2383532 | A | 7/2003 |
| GB | 2503685 | A | 1/2014 |
| GB | 2548815 | A | 10/2017 |
| GB | 2551852 | A | 1/2018 |
| GB | 2548813 | B | 2/2020 |
| GB | 2602656 | A | 7/2020 |
| GB | 2598924 | A | 3/2022 |
| GB | 2603176 | A | 8/2022 |
| JP | 59-197209 | A | 11/1984 |
| JP | 2015181946 | A | 10/2015 |
| JP | 2017170144 | A | 9/2017 |
| JP | 2017170149 | A | 9/2017 |
| JP | 2018536822 | A | 12/2018 |
| KR | 20150054017 | A | 5/2015 |
| KR | 10-1670509 | B1 | 10/2016 |
| RU | 2717734 | C1 | 3/2020 |
| TW | M580903 | U | 7/2019 |
| WO | 2013/041805 | A1 | 3/2013 |
| WO | 2015140507 | A1 | 9/2015 |
| WO | 2017/078191 | A1 | 5/2017 |
| WO | 2017/163066 | A1 | 9/2017 |
| WO | 2017163004 | A1 | 9/2017 |
| WO | 2020/025920 | A1 | 2/2020 |
| WO | 2020/109751 | A1 | 6/2020 |
| WO | 2020258824 | A1 | 12/2020 |
| WO | 2022/058710 | A1 | 3/2022 |
| WO | 2022/148960 | A1 | 7/2022 |
| WO | 2022/162336 | A1 | 8/2022 |
| WO | 2022/162337 | A1 | 8/2022 |
| WO | 2022/162338 | A1 | 8/2022 |
| WO | 2022/162339 | A1 | 8/2022 |
| WO | 2022/162340 | A1 | 8/2022 |

OTHER PUBLICATIONS

Examination Report received for GB Application No. 2101272.9, mailed on Mar. 7, 2023, 3 pages.
Search Report received for GB Application No. 2101272.9, mailed on Jul. 12, 2021, 2 pages.
Dyson, "The science behind the Dyson Airwrap(RTM) styler. The Coanda effect explained." YouTube(RTM), Apr. 10, 2020, Available from: https://www.youtube.com/watch?v=X1kQFJcKEaM.
Examination Report received for GB Application No. 2101264.6, mailed on Apr. 14, 2023, 3 pages.
Examination Report received for GB Application No. 2101265.3, mailed on Jun. 16, 2023, 1 page.
Examination Report received for GB Application No. 2101265.3, mailed on Mar. 3, 2023, 1 page.
Examination Report received for GB Application No. 2101265.3, mailed on Nov. 11, 2022, 4 pages.
Examination Report received for GB Application No. 2101266.1, mailed on May 22, 2023, 4 pages.
Examination Report received for GB Application No. 2101268.7, mailed on Mar. 28, 2023, 2 pages.
Examination Report received for GB Application No. 2101269.5, mailed on Jul. 20, 2023, 3 pages.
Examination Report received for GB Application No. 2101269.5, mailed on Mar. 28, 2023, 2 pages.
International Search Report and Written Opinion received for PCT Patent Application No. PCT/GB2022/050011, mailed on Apr. 7, 2022, 12 pages.
International Search Report and Written Opinion received for PCT Patent Application No. PCT/GB2022/050012, mailed on Apr. 7, 2022, 11 pages.
International Search Report and Written Opinion received for PCT Patent Application No. PCT/GB2022/050013, mailed on Apr. 5, 2022, 11 pages.
International Search Report and Written Opinion received for PCT Patent Application No. PCT/GB2022/050014, mailed on Apr. 5, 2022, 10 pages.
International Search Report and Written Opinion received for PCT Patent Application No. PCT/GB2022/050015, mailed on Apr. 8, 2022, 12 pages.
Search Report received for GB Application No. 2101264.6, mailed on Jul. 13, 2021, 1 page.
Search Report received for GB Application No. 2101265.3, mailed on Jul. 15, 2021, 1 page.
Search Report received for GB Application No. 2101266.1, mailed on Jul. 5, 2021, 1 page.
Search Report received for GB Application No. 2101269.5, mailed on Jul. 12, 2021, 2 pages.
Michele Trancossi, "An Overview of Scientific and Technical Literature on Coanda Effect Applied to Nozzles", SAE Technical Papers, Oct. 18, 2011, 14 pages.

* cited by examiner

HAIRCARE APPLIANCE

CROSS-REFERENCE TO PRIOR APPLICATIONS

This application is continuation of U.S. patent application Ser. No. 18/273,731, filed Jul. 21, 2023, which is a § 371 National Stage Application of PCT International Application No. PCT/GB2022/050012 filed Jan. 6, 2022, which claims the priority of United Kingdom Application No. 2101265.3, filed Jan. 29, 2021, each of which are herein incorporated by reference in their entirety.

FIELD OF THE INVENTION

The present invention relates to a haircare appliance, and an attachment for a haircare appliance.

BACKGROUND OF THE INVENTION

Haircare appliances are typically used to dry and style hair. Where haircare appliances are used to style hair to create a smooth appearance, the presence of shorter or broken hairs, sometimes referred to as flyaways, may impact on the desired smooth appearance.

SUMMARY OF THE INVENTION

According to a first aspect of the present invention there is provided an attachment for a attachment, the attachment comprising an air inlet, an air outlet, and a curved surface adjacent to and downstream of the air outlet, wherein the attachment is configured such that airflow exiting the air outlet in use generates a first force to attract hair toward the curved surface, and a second force to push hair away from the curved surface.

The attachment according to the first aspect of the present invention may be advantageous as the attachment is configured such that airflow exiting the air outlet generates a first force to attract hair toward the curved surface, and a second force to push hair away from the curved surface.

In particular, the inventors of the present application have determined that providing a curved surface adjacent to and downstream of the air outlet may generate a negative pressure region adjacent to the curved surface which attracts long hairs toward the curved surface, with the airflow interaction with hair also pushing shorter hairs away from the curved surface. This may result in shorter hairs being pushed through the longer hairs, for example through the longer hairs toward the side of hair facing a user's head, such that a smooth finish is provided.

Airflow exiting the air outlet may flow over the curved surface in use. The attachment may be configured such that a negative pressure region is generated in the vicinity of the curved surface in use. The curved surface may comprise a Coanda surface, for example a convex surface along which airflow is attached as a result of the Coanda effect in use.

The air outlet may comprise an open cross-sectional area in the region of 140 mm 2 to 450 $mm^2$, for example in the region of 280 mm 2 to 350 $mm^2$. The applicant has found that such an open cross-sectional area may be particularly effective in generating an airflow along the curved surface that results in a first force to attract hair toward the curved surface, and a second force to push hair away from the curved surface.

The air outlet may comprise a width in the region of 70 mm to 90 mm, for example in the region of 75 mm to 85 mm. The air outlet may comprise a height in the region of 2 mm to 5 mm. The air outlet may be generally rectangular in form, for example such that airflow leaving the air outlet has a generally laminar form.

The curved surface may comprise an arc angle of at least 95 degrees from the air outlet. The applicant has found that such an arc angle may be particularly effective in generating an airflow along the curved surface that results in a first force to attract hair toward the curved surface, and a second force to push hair away from the curved surface.

The curved surface may comprise an arc length of at least 95 degrees from the air outlet. The applicant has found that such an arc length may be particularly effective in generating an airflow along the curved surface that results in a first force to attract hair toward the curved surface, and a second force to push hair away from the curved surface.

A ratio of a radius of curvature of the curved surface to an arc length of the curved surface may be in the region of 0.04 to 0.63. The applicant has found that such a ratio may be particularly effective in generating an airflow along the curved surface that results in a first force to attract hair toward the curved surface, and a second force to push hair away from the curved surface.

The attachment may comprise a flat surface adjacent to and extending rearwardly from the air outlet.

Where a non-flat surface is provided extending rearwardly from the air outlet, the smooth finish can be disturbed as the attachment is moved relative to the hair in use, as may typically be the case during styling operations. Where a rough surface, for example a surface comprising projections such as bristles or the like, is provided extending rearwardly from the air outlet, such a rough surface may interrupt hair that has already been smoothed by airflow from the air outlet as the attachment is moved relative to the hair in use. By providing a curved surface adjacent to and downstream of the air outlet, and a flat surface adjacent to and extending rearwardly from the air outlet, a smooth hair finish may be created and maintained as the attachment is moved relative to hair by a user in use.

The flat surface may also act as a guide surface to ensure that the attachment is located correctly relative to a head of a user such that airflow exiting the air outlet is able to provide the functionality described above.

The flat surface may be substantially smooth and uninterrupted in form. The flat surface may comprise a height in the region of 5 mm to 20 mm.

The attachment may be configured such that the flat surface contacts hair extending rearwardly from the air outlet as the attachment is moved relative to hair in use, for example as the attachment is moved linearly in a direction along the hair, from roots of the hair to tips of the hair in use.

The flat surface may comprise a generally planar surface. This may aid with retention of a smooth hair surface as the attachment is moved relative to hair in use, and may ensure that hair extending rearwardly from the air outlet is supported by the surface.

The flat surface may be obliquely angled relative to a plane of the air outlet. This may ensure that hair extending rearwardly from the air outlet contacts the flat surface whilst hair downstream of the air outlet is attracted toward the curved surface in use. The flat surface may be obliquely angled relative to a plane tangential to the curved surface at a point of the curved surface immediately adjacent to the air outlet.

The attachment may comprise a pair of guide walls for guiding airflow along the curved surface, the pair of guide walls upstanding from the curved surface. By providing a pair of guide walls extending outwardly from the curved surface ambient air may be inhibited from impacting on a region of negative pressure generated by airflow flowing along the curved surface in use, and may result in increased attraction of hair toward the curved surface compared to, for example, a similar arrangement that does not utilise guide walls.

Each of the guide walls may be curved in form, for example with a curvature following a curvature of the curved surface. Guide walls of the pair of guide walls may oppose one another, for example such that a channel is defined therebetween, with the curved surface forming a bed of the channel. The pair of guide walls may be spaced apart along the curved surface from one another, for example spaced apart at opposing edges of the curved surface. A spacing between the guide walls may correspond substantially to a length of the air outlet. The curved surface may be substantially smooth and uninterrupted between the pair of guide walls. This may enable hair to wrap around the curved surface between the pair of guide walls in use.

The guide walls may project outwardly from the curved surface, for example with the guide walls and the curved surface integrally formed as a single component.

The pair of guide walls may extend along substantially an entire length of the curved surface. This may ensure that a negative pressure region is maintained along substantially the entire length of the curved surface.

The pair of guide walls may comprise a height substantially equal to a height of the air outlet. This may ensure that a negative pressure region is maintained along substantially the entire height of a jet of air that exits the air outlet in use.

The pair of guide walls may comprise a height substantially equal to a height of the air outlet in a region adjacent to the air outlet. The inventors of the present application have found that maintaining a negative pressure region in the region adjacent to the air outlet benefits creation of airflow along the curved surface which results in a first force that is sufficient to attract relatively long hair toward the first surface whilst also generating a second force to push relatively short hair away from the curved surface.

The pair of guide walls may comprise a radius of curvature greater than a radius of curvature of the curved surface. For example, the pair of guide walls may comprise a radius of curvature greater than a radius of curvature of the curved surface in a region adjacent to the air outlet. This may ensure that the pair of guide walls provide their functionality in the region adjacent to the air outlet in use.

The pair of guide walls may comprise a height that varies along a length of the guide wall. The inventors of the present application have found that the guide walls provide most impact in certain regions of the curved surface, for example in a region adjacent to the air outlet. The pair of guide walls may comprise a height that decreases in a direction away from the air outlet. By reducing a height of the guide walls in a direction away from the air outlet less material may be required to form the guide walls than, for example, guide walls of a constant height. The pair of guide walls may comprise a height that gradually decreases in a direction away from the air outlet, for example such that there are no step-changes in height. Guide walls of the pair of guide walls may each comprise the same height, and may be substantially symmetrical about an axis bisecting a space between the guide walls.

The pair of guide walls may comprise a constant height. This may provide certainty that a negative pressure region generated adjacent to the curved surface will not be impacted along the length of the curved surface.

The attachment may comprise an end wall located at an end of the curved surface. This may inhibit airflow from reaching a hand of a user holding the attachment in use.

The air outlet may comprise a fixed air outlet, for example an air outlet of fixed cross-sectional area, length and/or width. This may ensure that airflow characteristics of the attachment are constant for a given flow rate of airflow generated by the airflow generator, thereby ensuring that an airflow is generated along the curved surface that results in a first force to attract hair toward the curved surface, and a second force to push hair away from the curved surface. This may also provide a simpler attachment with fewer moving parts, and hence a reduced risk of failure, compared to a attachment with a variable air outlet.

The attachment may comprise a hollow body defining a flow path between the air inlet and the air outlet, the curved surface extending outwardly from the hollow body. As the curved surface extends outwardly from the hollow body, the hollow body, and/or the remainder of the attachment, may be removed from the region of hair wrapped about the curved surface in use, and hence may be prevented from disrupting a styling process that takes place in the region of the curved surface.

A central axis of curvature of the curved surface may displaced from a central axis of the hollow body, for example parallel to and displaced from a central axis of the hollow body, or orthogonal to and displaced from a central axis of the hollow body.

The curved surface may comprise a first end attached to the hollow body, and a second free end opposite to the first end, for example with the second free end not attached to the hollow body. The first end may be attached to the hollow body in a region of the air outlet, for example such that the curved surface extends outwardly of the air outlet. The curved surface may be generally arc-like in form.

The curved surface may be substantially smooth and uninterrupted in form. This may enable hair to wrap around the curved surface in use.

The curved surface may be integrally formed with the hollow body, for example such that the curved surface and the hollow body are formed as a single component. The air outlet may comprise a slot formed in the hollow body.

The attachment may comprise a single air outlet. This may ensure that there are no further air outlets to disrupt a smoothing process conducted using the attachment, and may ensure that airflow leaving the air outlet has the required characteristics to result in a first force to attract hair toward the curved surface, and a second force to push hair away from the curved surface.

The air outlet may comprise a first air outlet located on a first side of the attachment, and a second air outlet located on a second side of the attachment opposite to the first side of the attachment, the curved surface being adjacent to and downstream of each of the first and second air outlets, and the attachment comprising a first flat surface adjacent to and extending rearwardly from the first air outlet, and a second flat surface adjacent to and extending rearwardly from the second air outlet. Providing first and second air outlets, and first and second flat surfaces, may enable the attachment to be used in multiple orientations whilst still achieving the smoothing effect described above.

The curved surface may comprise a continuous surface extending between the first and second air outlets. Such a continuous surface may facilitate attraction of hair to the curved surface when the attachment is used in multiple orientations.

The attachment may comprise a switching mechanism for switching the attachment from a first configuration in which airflow passes through the first air outlet and does not pass through the second air outlet, to a second configuration in which airflow passes through the second air outlet and does not pass through the first air outlet. This may ensure that airflow only passes through one side of the attachment in use. This may prevent direction of airflow away from the head of a user in use, and hence may result is less wasted airflow and more efficient styling. This may also ensure that there is no stray airflow from an air outlet not used as part of the styling process that can impact the styling process in use.

The switching mechanism may be actuable to move the attachment between the first and second configurations under action of gravity. This may provide a simple switching mechanism that does not require user input, thereby enhancing the user experience.

A central axis of curvature of the curved surface may be substantially coincidental with a central axis of the airflow generator, for example substantially coincidental with a central axis of a housing within which the airflow generator is disposed.

The curved surface may be displaced relative to an edge of the air outlet, for example such that the curved surface does not extend directly from an edge of the air outlet. The curved surface may be displaced by between 0.5 mm and 1.5 mm from an edge of the air outlet. The curved surface may be displaced relative to an edge of the air outlet in a direction orthogonal to an edge of the air outlet, for example orthogonal to a lengthwise extending edge of the air outlet.

The attachment may comprise an internal baffle for turning airflow from the airflow generator toward the air outlet, for example turning airflow through around 90 degrees toward the air outlet.

According to a second aspect of the present invention there is provided a haircare appliance comprising an air inlet, an air outlet, an airflow generator for generating an airflow from the air inlet to the air outlet, and a curved surface adjacent to and downstream of the air outlet, wherein the haircare appliance is configured such that airflow exiting the air outlet generates a first force to attract hair toward the curved surface, and a second force to push hair away from the curved surface.

The haircare appliance may comprise a heater for heating the airflow. This may provide increased styling flexibility, and may, for example, enable the airflow to provide a drying function.

The haircare appliance may comprise a handle unit within which the airflow generator is housed, and an attachment releasably attachable to the handle unit, the attachment comprising the air outlet and the curved surface. Providing the air outlet and the curved surface as part of a removable attachment may allow the functionality described herein to be selectively provided by a user.

The haircare appliance may be configured such that airflow at the air outlet comprises a velocity in the region of 30 m/s to 45 m/s. The applicant has found that such a velocity may be particularly effective in generating an airflow along the curved surface that results in a first force that is sufficient to attract relatively long hair toward the first surface whilst also generating a second force to push relatively short hair away from the curved surface. The air outlet may be shaped and dimensioned such that airflow at the air outlet comprises a velocity in the region of 30 m/s to 45 m/s. The airflow generator may be configured to generate an airflow at a flow rate such that airflow at the air outlet comprises a velocity in the region of 30 m/s to 45 m/s.

The airflow generator may be configured to generate airflow at a flow rate in the region of 8 L/s to 14 L/s. The applicant has found that such an airflow rate may be particularly effective in generating an airflow along the curved surface that results in a first force that is sufficient to attract relatively long hair toward the first surface whilst also generating a second force to push relatively short hair away from the curved surface.

A ratio of flow rate of airflow generated by the airflow generator to an open cross-sectional area of the air outlet may be in the region of 0.01 to 0.10. The applicant has found that such a ratio may be particularly effective in generating an airflow along the curved surface that results in a first force to attract hair toward the curved surface, and a second force to push hair away from the curved surface.

A ratio of a radius of curvature of the curved surface to a velocity of airflow at the air outlet may be in the region of 0.33 to 2.00, for example in the range of 0.5 to 1.5. The applicant has found that such a ratio may be particularly effective in generating an airflow along the curved surface that results in a first force to attract hair toward the curved surface, and a second force to push hair away from the curved surface.

A ratio of a velocity of airflow at the air outlet to a flow rate of airflow generated by the airflow generator may in the region of 2.14 to 5.63, for example in the range of 2.6 to 3.6. The applicant has found that such a ratio may be particularly effective in generating an airflow along the curved surface that results in a first force to attract hair toward the curved surface, and a second force to push hair away from the curved surface.

When the attachment comprises an internal baffle for turning airflow from the airflow generator toward the air outlet, for example turning airflow through around 90 degrees toward the air outlet. This may enable a main portion of the haircare appliance housing the airflow generator to extend orthogonally relative to the air outlet, which may provide greater flexibility in design, and better ergonomics, than, for example a haircare appliance where the air outlet is aligned with a main portion of the haircare appliance housing the airflow generator.

Optional features of aspects of the present invention may be equally applied to other aspects of the present invention, where appropriate.

DETAILED DESCRIPTION OF THE INVENTION

Figure 1:
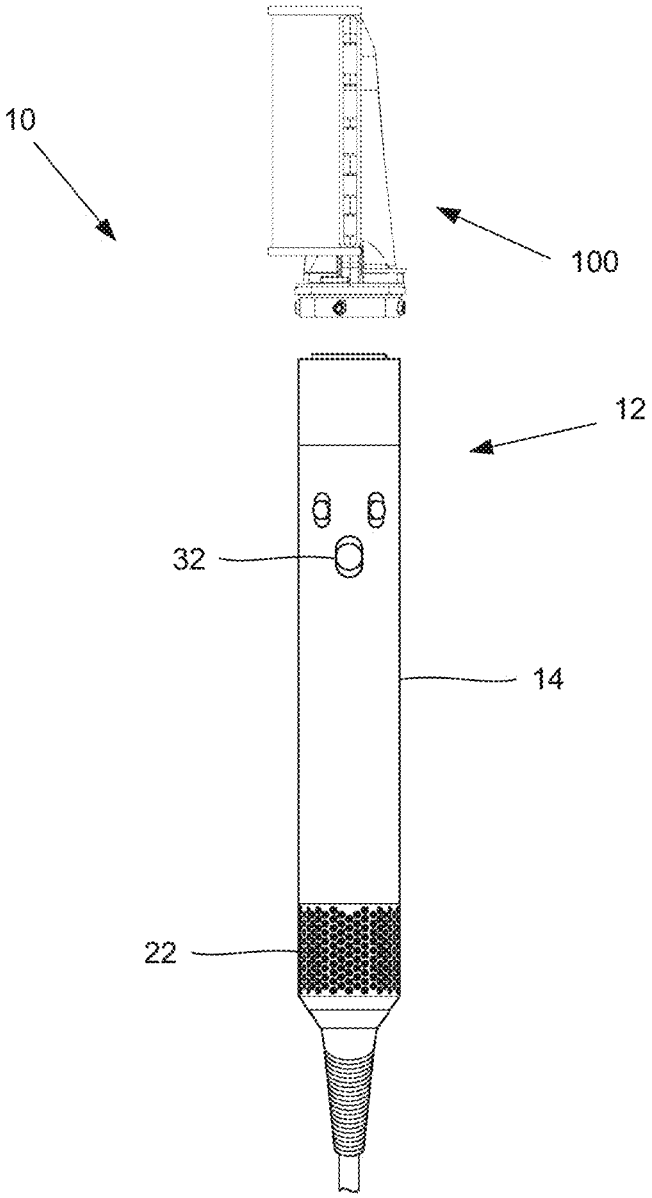
FIG. 1 is a schematic view illustrating a haircare appliance according to the present invention.

A haircare appliance according to the present invention, generally designated 10, is shown schematically in FIG. 1.

The haircare appliance 10 comprises a handle unit 12, and an attachment 100 removably attachable to the handle unit 12.

Figure 2:
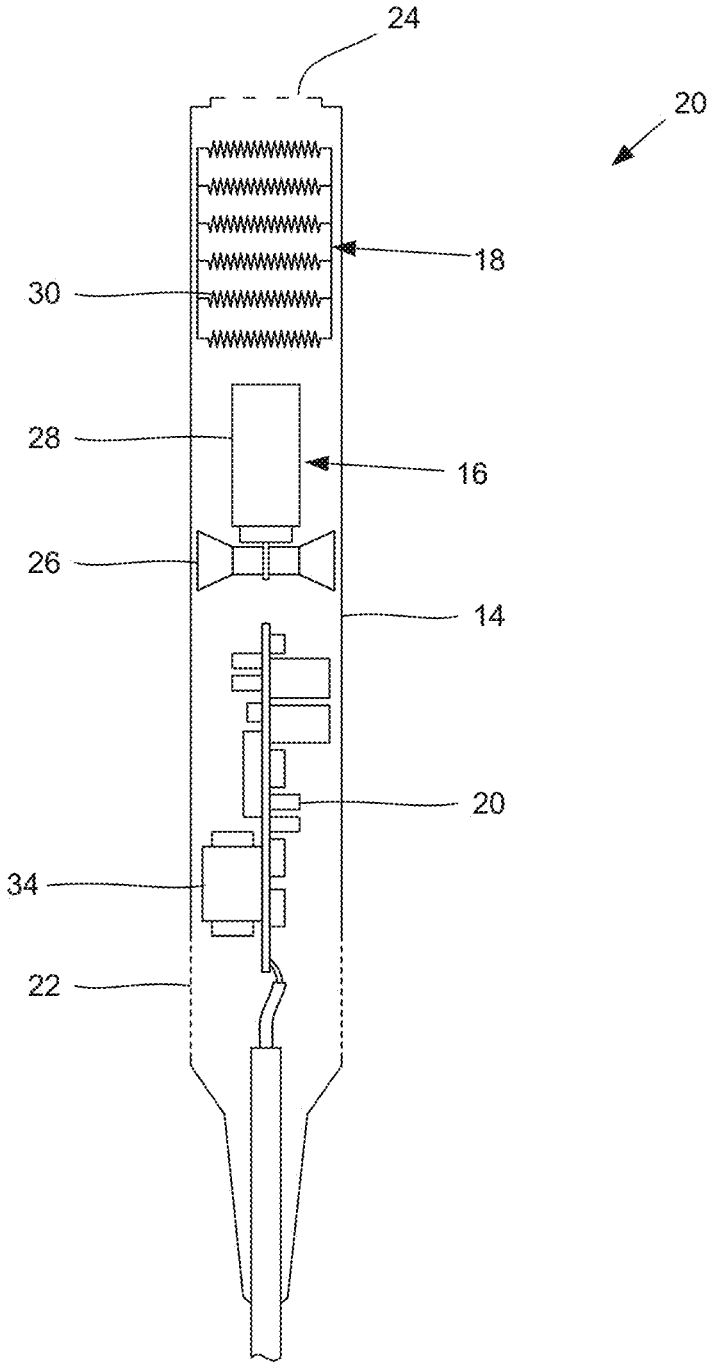
FIG. 2 is a schematic cross-sectional view through a handle unit of the haircare appliance of FIG. 1.

The handle unit 12 comprises a housing 14, an airflow generator 16, a heater 18, and a control unit 20, as can be seen schematically in FIG. 2.

The housing 14 is tubular in shape, and comprises an air inlet 22 through which an airflow is drawn into the housing 14 by the airflow generator 16, and an air outlet 24 through which the airflow is discharged from the housing 14. The airflow generator 16 is housed within the housing 14, and comprises an impeller 26 driven by an electric motor 28. The airflow generator is configured to generate airflow at a flow rate in the region of 8 to 14 L/S, for example in the region of 10 to 13 L/s. An appropriate airflow generator is the Dyson V9 Digital Motor, produced by Dyson Technology Limited. The heater 18 is also housed within the housing 14, and comprises heating elements 30 to optionally heat the airflow.

The control unit 20 comprises electronic circuitry for a user interface 32 and a control module 34. The user interface 32 is provided on an outer surface of the housing 14, and is used to power on and off the haircare appliance 10, to select a flow rate (for example high, medium and low), and to select an airflow temperature (for example hot, medium or cold). In the example of FIG. 1, the user interface comprises a plurality of sliding switches, but other forms of user interface 32, for example buttons, dials or touchscreens, are also envisaged.

The control module 34 is responsible for controlling the airflow generator 16, and the heater 18 in response to inputs from the user interface 32. For example, in response to inputs from the user interface 32, the control module 34 may control the power or the speed of the airflow generator 16 in order to adjust the airflow rate of the airflow, and the power of the heater 18 in order to adjust the temperature of the airflow.

Figure 3:
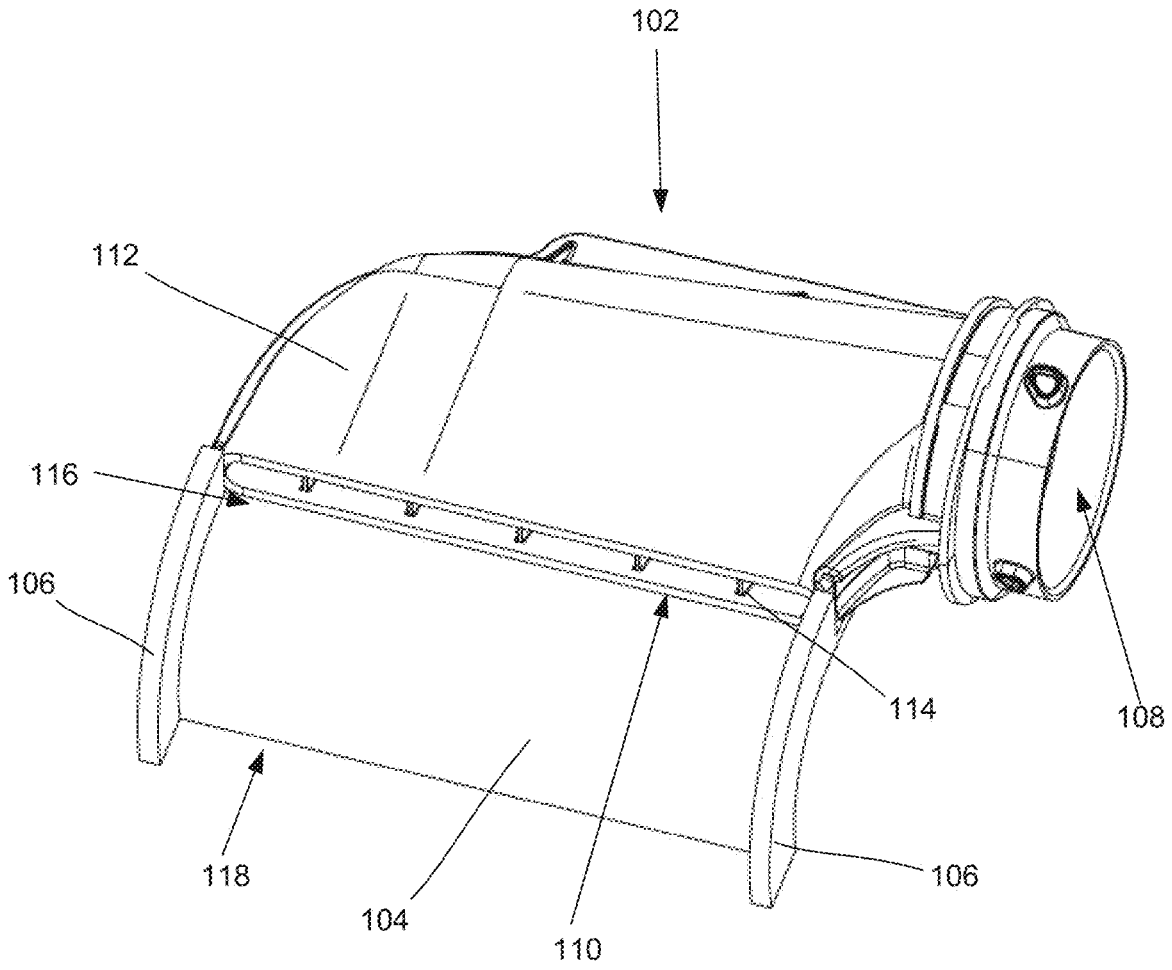
FIG. 3 is a schematic perspective view of a first embodiment of an attachment for the haircare appliance of FIG. 1.
Figure 4:
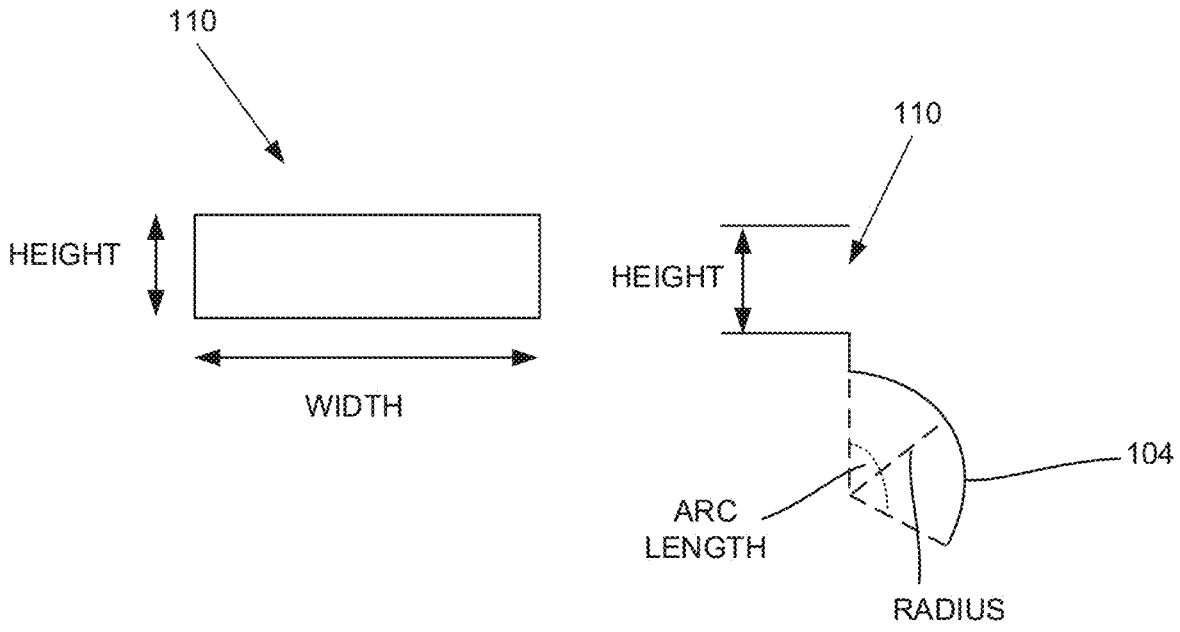
FIG. 4 is a schematic view illustrating geometry of the attachment of FIG. 3.

The attachment 100 is shown schematically in FIGS. 3 and 4.

The attachment 100 comprises a hollow body 102, a curved surface 104, and a pair of guide walls 106. The hollow body 102 comprises an air inlet 108, an air outlet 110, a flat surface 112, and a plurality of internal baffles 114.

The air inlet 108 comprises a generally circular aperture formed in the hollow body 102, and the air inlet 108 is configured to receive airflow from the air outlet 24 of the handle unit 12 when the attachment 100 is attached to the handle unit 12 in use. A periphery of the air inlet 108 comprises attaching features for releasably attaching the attachment 100 to the handle unit 12. The attaching features may take many forms, are not pertinent to the present invention, and so will not be described for the sake of brevity.

The air outlet 110 comprises a generally rectangular slot formed lengthwise along a side of the hollow body 110. The air outlet 110 has a width in the region of 70 mm to 90 mm, for example in the region of 75 mm to 85 mm, and a height in the region of 2 mm to 5 mm, for example in the region of 3.0 mm to 4.5 mm. This gives an overall open cross-sectional area of the air outlet 110 in the region of 140 mm 2 to 450 $mm^2$, for example in the region of 225.0 mm 2 to 382.5 $mm^2$.

In a presently preferred embodiment the width of the air outlet 110 is in the region of 77 mm, and the height of the air outlet 110 is in the region of 4.5 mm. The open cross-sectional area of the air outlet 110 is in the region of 346.5 $mm^2$. The inventors of the present application have found that such dimensions for the air outlet 110 may provide advantageous effects, as will be described hereafter.

The plurality of internal baffles 114 are curved in form, and extend in a direction from the air inlet 108 to the air outlet 110. The plurality of internal baffles 114 are configured to turn airflow in a direction from the air inlet 108 to a direction toward the air outlet 110, such that airflow is turned through substantially 90 degrees from the air inlet 108 to the air outlet 110. This may enable the handle unit 12 to extend orthogonally relative to the air outlet 110, which may provide greater flexibility in design, and better ergonomics, than, for example a haircare appliance where the air outlet is aligned with a handle unit of the haircare appliance.

The flat surface 112 is located adjacent to and extends rearwardly from of the air outlet 110, such that the flat surface 112 extends rearwardly from an edge of the air outlet 110. The flat surface 112 is obliquely angled relative to a plane in which the air outlet 110 is disposed, for example at an angle in the range of 3-10 degrees. The flat surface 112 is generally planar in form, and is substantially smooth and uninterrupted, for example with no projections, recesses or apertures formed thereon. The flat surface 112 has a height in the region of 5 mm to 20 mm. The functionality of the flat surface 112 will be described hereafter.

The curved surface 104 is illustrated schematically in FIG. 4, and extends outwardly from the hollow body 102 in a region of the air outlet 110, for example with a first edge 116 of the curved surface 104 attached to the hollow body 102 adjacent to the air outlet 110. Thus the curved surface 104 is located adjacent to, and downstream of, the air outlet 110. A second edge 118 of the curved surface 102 is a free edge, such that the curved surface 104 is cantilevered relative to the hollow body 102. The first edge 116 of the curved surface 104 is displaced slightly from the air outlet 110, for example by a distance in the region of 0.5-1.5 mm, such that there is a slight step down from the air outlet 110 to the curved surface 102. It will be appreciated that in some embodiments there may be no step down from the air outlet 110 to the curved surface 104.

The curved surface 102 is substantially smooth and uninterrupted in form, such that no projections, recesses or apertures are formed thereon. This may enhance the functionality of the attachment 100 which will be described hereafter. The curved surface 102 has a radius of curvature in the region of 16 mm to 60 mm, for example in the region of 20 mm to 40 mm, and has an arc angle in the region of 95 to 360 degrees, for example in the region of 95 to 120 degrees. In a presently preferred embodiment, the curved surface 102 has a radius of curvature in the region of 20 mm and an arc angle in the region of 110 degrees. The inventors of the present application have found that such a geometry of the curved surface 102 may provide advantageous effects, as will be described hereafter.

The pair of guide walls 106 are disposed on opposing edges of the curved surface 102, with those edges orthogonal to the first 116 and second 118 edges of the curved surface 102 mentioned previously. The guide walls 106 are upstanding from the curved surface 102, and extend along the full arc length of the curved surface 102. The guide walls 106 have a height substantially corresponding to a height of the air outlet 110, and have a constant height along their length.

In use, the attachment 100 is attached to the handle unit 12. The airflow generator 16 generates an airflow from the air inlet 22 of the handle unit 12 to the air outlet 24 of the handle unit 12, such that airflow passes from the air outlet 24 of the handle unit to the air inlet 108 of the attachment 100. Airflow flows from the air inlet 108 of the attachment through the hollow body 102, and is turned by the plurality of internal baffles 114 toward the air outlet 110 of the attachment 100. Airflow exits the hollow body 102 via the air outlet 110 and passes over the curved surface 102.

The inventors of the present application have found that airflow attaches to the curved surface 102 via the Coanda effect. When a tress of hair is brought into the vicinity of the attachment 100, long hairs of the tress are attracted to, and at least partially wrapped about, the curved surface 102 by a force F_PULL, as a result of a negative pressure region generated by the airflow over the curved surface 102. However, the pressure gradient across the tress also results in a force, F_PUSH, which causes some airflow to pass directly through the tress. Due to the location of this force relative to the curved surface 102 and the rest of the tress, shorter hairs are only held loosely at this point compared to longer hairs which are held in place on the curved surface 102. The shorter hairs are blown through the tress toward a user's head, whilst the longer hairs remain in place on the outside of the tress, ie the portion of the tress facing away from the user's head. This provides a smooth finish for hair following interaction with the haircare appliance 10 and associated attachment 100.

Figure 5:
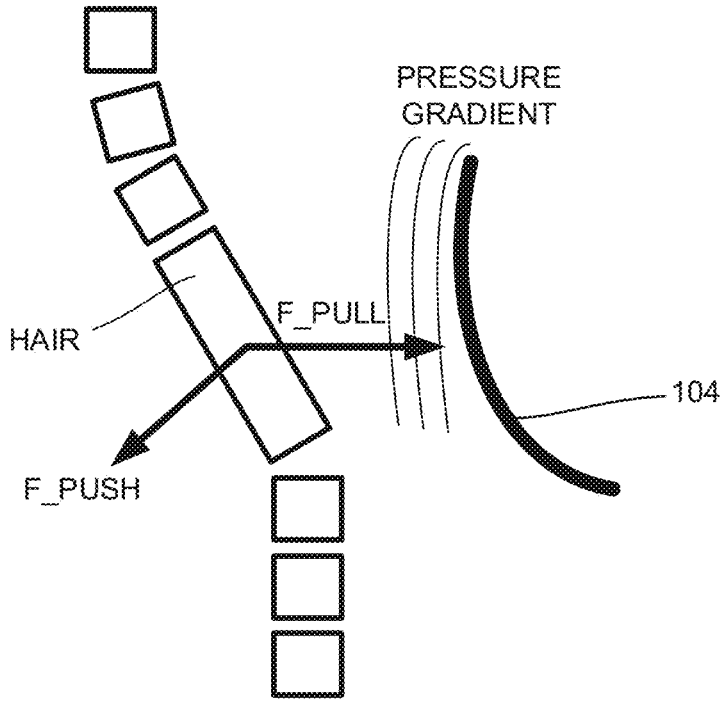
FIG. 5 is a schematic view illustrating forces created by airflow through the attachment of FIG. 3 in use.

The interaction of forces described above is illustrated schematically in FIG. 5.

This effect can be optimised by appropriate modification of the geometries and parameters described herein. One such parameter that may provide increased effectiveness is the velocity of airflow at the air outlet 110 of the attachment 100. In particular, too great a velocity may result in shorter hairs sticking to the curved surface 102 and hence not being pushed away through longer hairs, whilst too low a velocity may not be sufficient to attract longer hairs to the curved surface 102 in the first instance. The applicant has determined that a velocity in the region of 30 m/s to 45 m/s may be particularly effective in generating an airflow along the curved surface 102 that results in a first force that is sufficient to attract relatively long hair toward the curved surface 102 whilst also generating a second force to push relatively short hair away from the curved surface 102. In a presently preferred embodiment, the velocity of airflow at the air outlet 110 is in the region of 35 m/s.

Another parameter that may provide increased efficacy for smoothing hair in the manner described above is a ratio of the velocity of airflow at the air outlet 110 to a flow rate of airflow generated by the airflow generator 16. In the embodiment of FIGS. 3 to 4, the ratio is in the region of 2.14 to 5.63, and in a particularly preferred embodiment the ratio is in the region of 2.89. The applicant has found that such a ratio may be particularly effective in generating an airflow along the curved surface 102 that results in a first force that is sufficient to attract relatively long hair toward the curved surface 102, whilst also generating a second force to push relatively short hair away from the curved surface 102.

Another parameter that may provide increased efficacy for smoothing hair in the manner described above is a ratio of flow rate of airflow generated by the airflow generator 16 to an open cross-sectional area of the air outlet 110. In the embodiment of FIGS. 3 to 4, the ratio is in the region of 0.01 to 0.10, and in a particularly preferred embodiment the ratio is in the region of 0.04. The applicant has found that such a ratio may be particularly effective in generating an airflow along the curved surface 102 that results in a first force that is sufficient to attract relatively long hair toward the curved surface 102, whilst also generating a second force to push relatively short hair away from the curved surface 102.

A further parameter that may provide increased efficacy for smoothing hair in the manner described above is a ratio of a radius of curvature of the curved surface 102 to the velocity of airflow at the air outlet 110. In the embodiment of FIGS. 3 to 4, the ratio is in the region of 0.33 to 2.00, and in a particularly preferred embodiment the ratio is in the region of 0.57. The applicant has found that such a ratio may be particularly effective in generating an airflow along the curved surface 102 that results in a first force that is sufficient to attract relatively long hair toward the curved surface 102, whilst also generating a second force to push relatively short hair away from the curved surface 102.

Another parameter that may provide increased efficacy for smoothing hair in the manner described above is a ratio of a radius of curvature of the curved surface 102 to an arc length of the curved surface 102. In the embodiment of FIGS. 3 to 4, the ratio is in the region of 0.04 to 0.63, and in a particularly preferred embodiment the ratio is in the region of 0.18. The applicant has found that such a ratio may be particularly effective in generating an airflow along the curved surface 102 that results in a first force that is sufficient to attract relatively long hair toward the curved surface 102, whilst also generating a second force to push relatively short hair away from the curved surface 102.

In use, the attachment 100 can be moved along a length of a tress of hair, for example in a direction from root to tip of hair of the tress. The flat surface 112 is positioned relative to the curved surface 102 such that the flat surface 112 contacts hair extending rearwardly from of the air outlet 110 whilst hair downstream of the air outlet 110 contacts the curved surface 102. As previously mentioned, the flat surface 112 is substantially smooth and uninterrupted in form, with no projections, recesses or apertures formed thereon. As the haircare appliance 10 is moved along a length of a tress of hair in use, the flat surface 112 passes across hair that has been smoothed via interaction with the curved surface 102. In view of the smooth and uninterrupted nature of the flat surface 112, the flat surface 112 does not disrupt hair that has already been smoothed, leading to a better finish than, for example, a corresponding haircare appliance that has bristles and/or further air outlets located rearwardly of the air outlet 110.

As mentioned above, the pair of guide walls 106 extend along opposing edges of the curved surface 102. This effectively creates an airflow channel, with the pair of guide walls 106 acting as walls of the channel, and the curved surface 102 acting as a bed of the channel. The guide walls 106 inhibit ambient air from interacting with airflow flowing along the curved surface 102 in use, which may maintain the negative pressure region created by airflow flowing along the curved surface 102.

Figure 6:
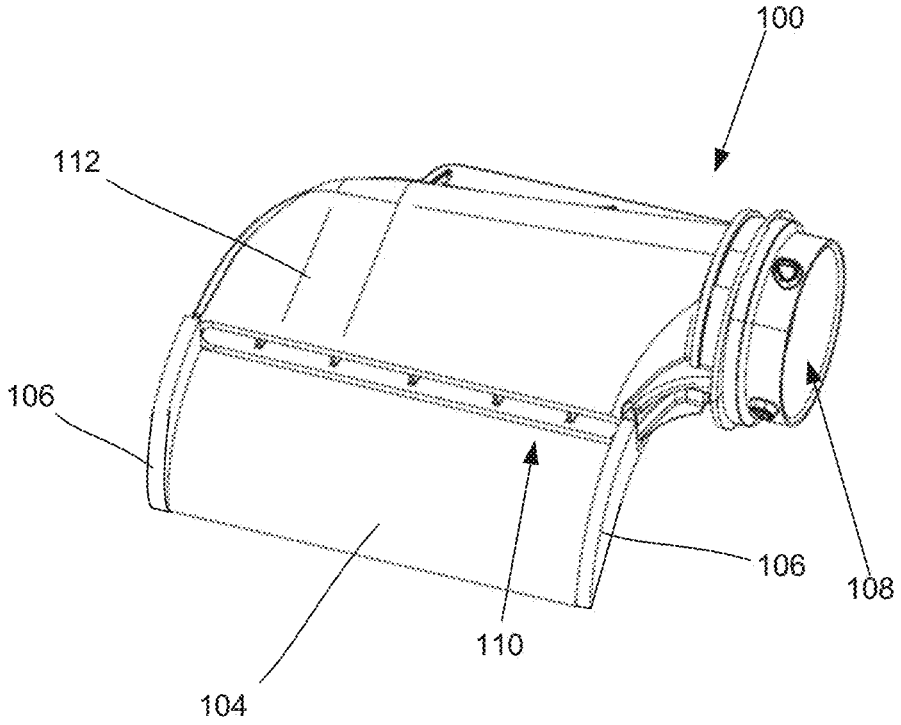
FIG. 6 is a schematic perspective view of a modified version of the attachment of FIG. 3.
Figure 7:
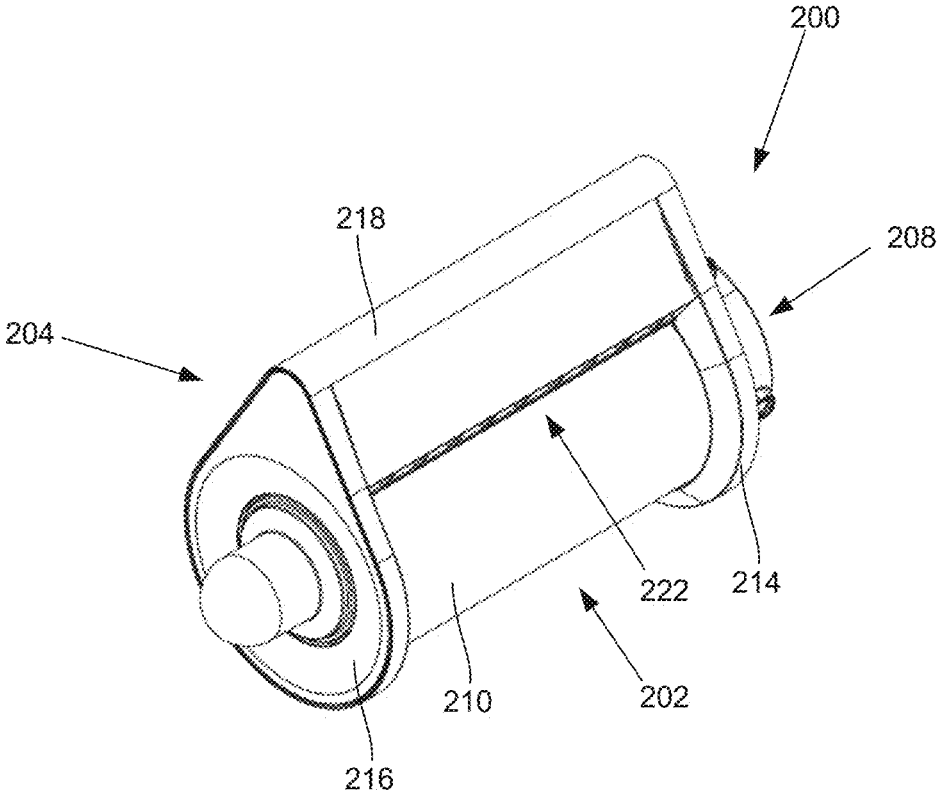
FIG. 7 is a schematic perspective view of a second embodiment of an attachment for the haircare appliance of FIG. 1.
Figure 8:
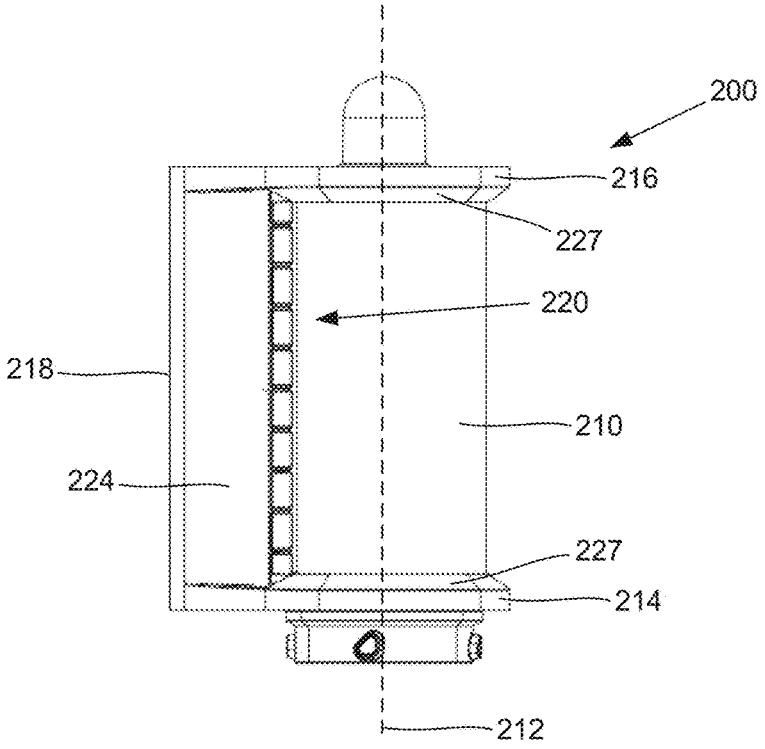
FIG. 8 is a first side view of the attachment of FIG. 7.
Figure 9:
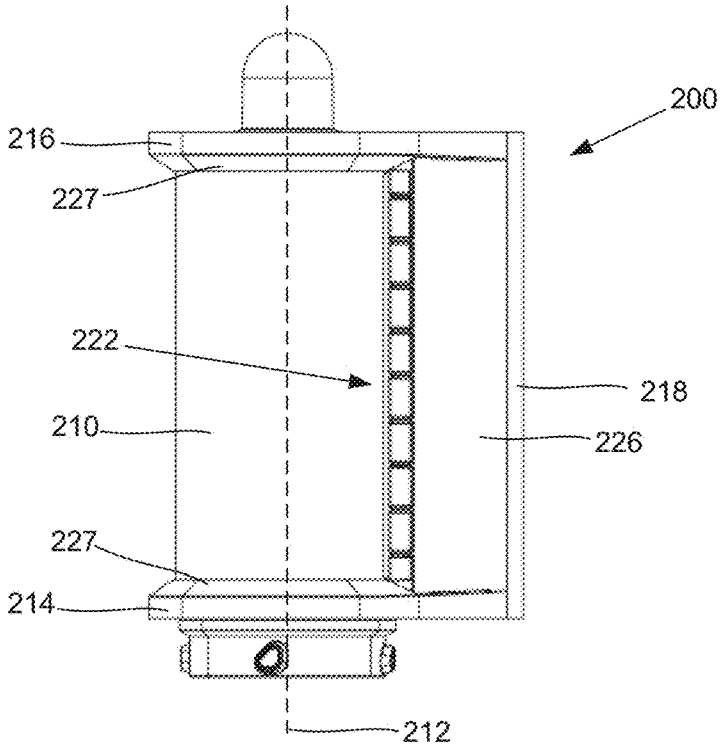
FIG. 9 is a second side view of the attachment of FIG. 7.

Whilst depicted in FIGS. 3 to 4 as having guide walls 106 of constant height along the curved surface 102, it has been found that the guide walls 106 may be most effective in the region of the air outlet 110. In alternative embodiments, as illustrated schematically in FIG. 6 the attachment 100 has guide walls 120 that decrease in height in a direction away from the air outlet 110. Thus less material may be required to form the guide walls 120 than, for example, guide walls 106 of a constant height.

In the embodiment previously described, the attachment has a single fixed air outlet 110, which is effectively a slot formed in the hollow body 104.

An alternative embodiment of an attachment 200 with multiple air outlets is illustrated schematically in FIGS. 7 to 11.

The attachment 200 comprises an inlet barrel 202, an outlet body 204, and a flow guide 206. The inlet barrel 202 is substantially cylindrical in form, and comprises an air inlet 208 which is configured to receive airflow from the air outlet 24 of the handle unit 12 when the attachment 200 is attached to the handle unit 12 in use. A periphery of the air inlet 208 comprises attaching features for releasably attaching the attachment 200 to the handle unit 12. The attaching features may take many forms, are not pertinent to the present invention, and so will not be described for the sake of brevity.

The inlet barrel 202 defines a curved surface 210. The curved surface 210 is substantially smooth and uninterrupted in form, such that no projections, recesses or apertures are formed thereon. This may enhance the functionality of the attachment 200 which will be described hereafter. The curved surface 210 has a radius of curvature in the region of 16 mm to 60 mm, for example in the region of 20 mm to 40 mm, and has an arc angle in the region of 95 degrees to 360 degrees. In a presently preferred embodiment, the curved surface 210 has a radius of curvature in the region of 20 mm and an arc angle in the region of 296 degrees. The inventors of the present application have found that such a geometry of the curved surface 210 may provide advantageous effects, as will be described hereafter.

The inlet barrel 202 comprises a central pivot axis 212 about which the flow guide 206 is pivotable, as will be described hereafter.

The outlet body 204 comprises a first end portion 214, a second end portion 216, and a connecting portion 218 extending between the first 214 and second 216 end portions. The first end portion 214 is generally teardrop shaped in form, and comprises an aperture (not shown) through which the inlet barrel 202 extends, such that at least a portion of the first end portion 214 extends annularly about the inlet barrel 202.

The second end portion 216 has generally the same teardrop form as the first end portion 214, but is substantially solid, and defines a cap for the inlet barrel 202.

The connection portion 218 extends between apexes of the first end portion 214 and the second end portion 216 along the curved surface 210 of the inlet barrel 202. The connecting portion 218 has the general form of a triangular prism.

The connecting portion 218 has a first air outlet 220, a second air outlet 222, a first flat surface 224, and a second flat surface 226. The first air outlet 220 and the second air outlet 222 are located on opposing sides of the connecting portion 218, such that the first 220 and second 222 air outlets are located on opposing sides of the inlet barrel 202, and hence opposing sides of the attachment 200. The curved surface 210 of the inlet barrel 202 is located adjacent to and downstream of each of the first 220 and second 222 air outlets, such that the curved surface 210 extends continuously between the first 220 and second 222 air outlets. The first 214 and second 216 end portions have dimensions that are slightly larger than those of the inlet barrel 202, such that guide walls 227 are formed about the periphery of the curved surface 210.

Each of the first 220 and second 222 air outlets is generally rectangular in overall form. The first 220 and second 222 air outlets each have a width in the region of 70 mm to 90 mm, for example in the region of 75 mm to 85 mm and a height in the region of 2 mm to 5 mm, for example in the region of 3 mm to 4.5 mm. This gives an overall open cross-sectional area of each of the first 220 and second 222 air outlets in the region of 140 mm 2 to 450 $mm^2$, for example in the region of 225 mm 2 to 382.5 $mm^2$.

In a presently preferred embodiment the width of each of first 220 and second 222 air outlets is in the region of 77 mm, and the height of each of the first 220 and second 222 air outlets is in the region of 4.5 mm. The open cross-sectional are of each of the first 220 and second 222 air outlets is in the region of 346.5 $mm^2$. The inventors of the present application have found that such dimensions for each of the first 220 and second 222 air outlets may provide advantageous effects, as will be described hereafter. Each of the first 220 and second 222 air outlets in the embodiment of FIGS. 7 to 11 are split into smaller sub-outlets, but the overall dimensions of the first 220 and second 222 air outlets are those given above.

The first flat surface 224 is located adjacent to and extends rearwardly from of the first air outlet 220, whilst the second flat surface 226 is located adjacent to and extends rearwardly from the second air outlet 222. The first 224 and second 226 flat surfaces are located either side of an apex of the connecting portion, such that the first 224 and second 226 flat surfaces are located on opposing sides of the attachment 200. The first 224 and second 226 flat surfaces are generally planar in form, and are substantially smooth and uninterrupted, for example with no projections, recesses or apertures formed thereon. The first 224 and second 226 flat surfaces are obliquely angled relative to planes in which the respective first 220 and second 222 air outlets are formed.

The connecting portion 218 further comprises first 228 and second 230 airflow channels which can be selectively placed in fluid communication with the interior of the inlet barrel 202, as will be described hereafter.

The flow guide 206 comprises a first blocking surface 232, a second blocking surface 234, a flow slot 236, connecting arms 238 and a plurality of weights 240.

The first 232 and second 234 blocking surfaces are substantially solid in form, and selectively block the respective first 228 and second 230 airflow channels. The flow slot 236 is formed between the first 232 and second 234 blocking surfaces, and selectively provides fluid communication between the first 228 and second 230 airflow channels and the interior of the inlet barrel 202. The connecting arms 238 are located at upper and lower regions of the flow guide 206, and pivotally connect the flow guide 206 to the central pivot axis 212 of the inlet barrel 202. The first 232 and second 234 blocking surfaces are slidably received within channels 242 formed in the walls of the inlet barrel 202 to enable pivoting motion of the flow guide 206 relative to the inlet barrel 202. The plurality of weights 240 are embedded in the first 232 and second 234 blocking surfaces. The flow guide 206 also has a plurality of internal baffles 244 which turn airflow from the air inlet 208 toward the flow slot 236.

Figure 10:
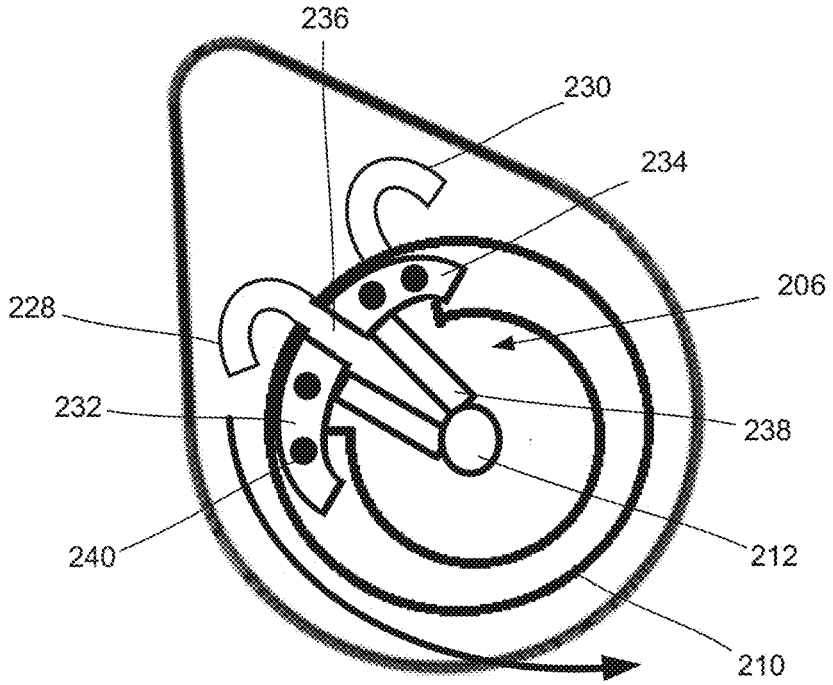
FIG. 10 is a schematic view illustrating the attachment of FIG. 7 in a first configuration.
Figure 11:
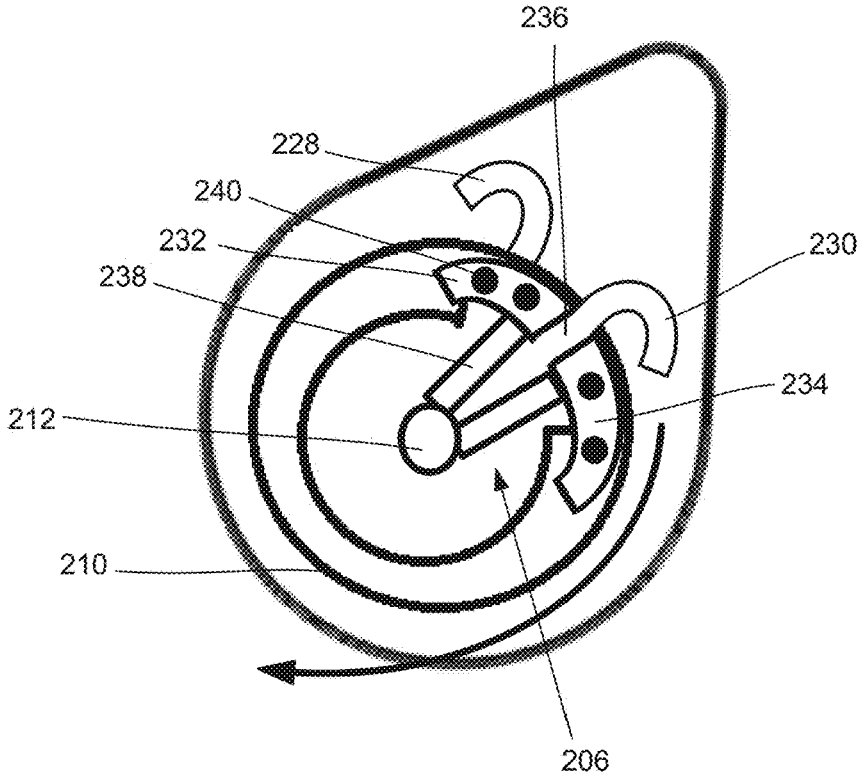
FIG. 11 is a schematic view illustrating the attachment of FIG. 7 in a second configuration.
Figure 12:
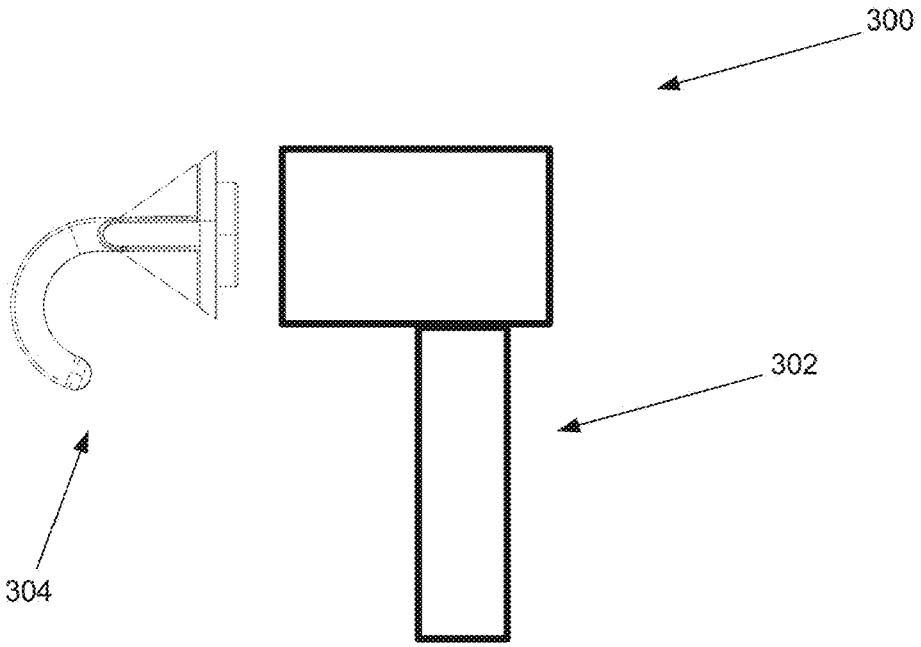
FIG. 12 is a schematic perspective view of a further embodiment of a haircare appliance according to the present invention.

The flow guide 206 is movable within the attachment 200 between a first configuration illustrated in FIG. 10 and a second configuration illustrated in FIG. 11.

In the first configuration, ie a configuration in which the attachment 200 is held on a left-hand side of a head of a user with the first flat surface 224 in contact with hair, the plurality of weights 240 ensure that the flow slot 236 is aligned with the first airflow channel 228, whilst the second blocking surface 234 is aligned with the second airflow channel 230. Thus airflow can escape from the first air outlet 220 but not from the second air outlet 222 in the first configuration.

In the second configuration, ie a configuration in which the attachment 200 is held on a right-hand side of a head of a user with the second flat surface 226 in contact with hair, the plurality of weights 240 ensure that the flow slot 236 is aligned with the second airflow channel 230, whilst the first blocking surface 232 is aligned with the first airflow channel 228. Thus airflow can escape from the second air outlet 222 but not from the first air outlet 220 in the second configuration.

The attachment 200 can therefore be used on either side of a user's head with ease, with the plurality of weights 240 providing a switching mechanism that can automatically switch the flow guide 206 between the first and second configurations without need for user interaction.

Similar to the attachment 100 of FIGS. 3 and 4, in use, the attachment 200 is attached to the handle unit 12. The airflow generator 16 generates an airflow from the air inlet 22 of the handle unit 12 to the air outlet 24 of the handle unit 12, such that airflow passes from the air outlet 24 of the handle unit to the air inlet 208 of the attachment 200. Airflow flows from the air inlet 208 of the attachment through the inlet barrel 202, and is turned by the plurality of internal baffles 244 toward the flow slot 236. Airflow exits the attachment via either the first 220 or second 222 air outlet, depending upon which of the first and second configurations the attachment is in, and passes over the curved surface 210.

The inventors of the present application have found that airflow attaches to the curved surface 210 via the Coanda effect. When a tress of hair is brought into the vicinity of the attachment 200, long hairs of the tress are attracted to, and at least partially wrapped about, the curved surface 210, as a result of a negative pressure region generated by the airflow over the curved surface 210. However, the pressure gradient across the tress also results in a force which causes some airflow to pass directly through the tress. Due to the location of this force relative to the curved surface 210 and the rest of the tress, shorter hairs are only held loosely at this point compared to longer hairs which are held in place on the curved surface 210. The shorter hairs are blown through the tress toward a user's head, whilst the longer hairs remain in place on the outside of the tress, ie the portion of the tress facing away from the user's head. This provides a smooth finish for hair following interaction with the haircare appliance 10 and associated attachment 100.

This effect can be optimised by appropriate modification of the geometries and parameters described herein. One such parameter that may provide increased effectiveness is the velocity of airflow at the air outlets 220,222 of the attachment 200. In particular, too great a velocity may result in shorter hairs sticking to the curved surface 210 and hence not being pushed away through longer hairs, whilst too low a velocity may not be sufficient to attract longer hairs to the curved surface 210 in the first instance. The applicant has determined that a velocity in the region of 30 to 45 m/s may be particularly effective in generating an airflow along the curved surface 210 that results in a first force that is sufficient to attract relatively long hair toward the curved surface 210 whilst also generating a second force to push relatively short hair away from the curved surface 210. In a presently preferred embodiment, the velocity of airflow at the air outlets 220,222 is in the region of 35 m/s.

Another parameter that may provide increased efficacy for smoothing hair in the manner described above is a ratio of the velocity of airflow at the air outlets 220,222 to a flow rate of airflow generated by the airflow generator 16. In the embodiment of FIGS. 7 to 11, the ratio is in the region of 2.14 to 5.63, and in a particularly preferred embodiment the ratio is in the region of 2.89. The applicant has found that such a ratio may be particularly effective in generating an airflow along the curved surface 210 that results in a first force that is sufficient to attract relatively long hair toward the curved surface 210, whilst also generating a second force to push relatively short hair away from the curved surface 210.

Another parameter that may provide increased efficacy for smoothing hair in the manner described above is a ratio of flow rate of airflow generated by the airflow generator 16 to an open cross-sectional area of one of the air outlets 220, 222. In the embodiment of FIGS. 7 to 11, the ratio is in the region of 0.01 to 0.10, and in a particularly preferred embodiment the ratio is in the region of 0.04. The applicant has found that such a ratio may be particularly effective in generating an airflow along the curved surface 210 that results in a first force that is sufficient to attract relatively long hair toward the curved surface 210, whilst also generating a second force to push relatively short hair away from the curved surface 210.

A further parameter that may provide increased efficacy for smoothing hair in the manner described above is a ratio of a radius of curvature of the curved surface 210 to the velocity of airflow at the air outlets 220,222. In the embodiment of FIGS. 7 to 11, the ratio is in the region of 0.33 to 2.00, and in a particularly preferred embodiment the ratio is in the region of 0.57. The applicant has found that such a ratio may be particularly effective in generating an airflow along the curved surface 210 that results in a first force that is sufficient to attract relatively long hair toward the curved surface 210, whilst also generating a second force to push relatively short hair away from the curved surface 210.

Another parameter that may provide increased efficacy for smoothing hair in the manner described above is a ratio of a radius of curvature of the curved surface 210 to an arc length of the curved surface 210. In the embodiment of FIGS. 7 to 11, the ratio is in the region of 0.04 to 0.63, and in a particularly preferred embodiment the ratio is in the region of 0.07. The applicant has found that such a ratio may be particularly effective in generating an airflow along the curved surface 210 that results in a first force that is sufficient to attract relatively long hair toward the curved surface 210, whilst also generating a second force to push relatively short hair away from the curved surface 210.

In use, the attachment 200 can be moved along a length of a tress of hair, for example in a direction from root to tip of hair of the tress. The first and second flat surfaces 224,226 are positioned relative to the curved surface 210 such that the flat surfaces 224,226 contact hair extending rearwardly from of the air outlets 220,222 whilst hair downstream of the air outlets 220,222 contacts the curved surface 210. As previously mentioned, the flat surfaces 224,226 are substantially smooth and uninterrupted in form, with no projections, recesses or apertures formed thereon. As the haircare appliance 10 and associated attachment 100 is moved along a length of a tress of hair in use, the flat surfaces 224,226 pass across hair that has been smoothed via interaction with the curved surface 210. In view of the smooth and uninterrupted nature of the flat surfaces 224,226, the flat surfaces 224,226 do not disrupt hair that has already been smoothed, leading to a better finish than, for example, a corresponding haircare appliance that has bristles and/or further air outlets located rearwardly of the air outlets 220,222.

The guide walls 244 extend along opposing edges of the curved surface 210. This effectively creates an airflow channel, with the guide walls 244 acting as walls of the channel, and the curved surface 210 acting as a bed of the channel. The guide walls 244 inhibit ambient air from interacting with airflow flowing along the curved surface 210 in use, which may maintain the negative pressure region created by airflow flowing along the curved surface 210.

An alternative embodiment of a haircare appliance 300 is illustrated schematically in FIGS. 12 to 15.

The haircare appliance 300 comprises a handle unit 302 and an attachment 306. The handle unit 302 comprises a handle portion 308, a head portion 310, an airflow generator 312 and a heater 314.

The handle portion 308 is generally cylindrical and hollow in form, and houses the airflow generator 312. The handle portion 308 has an air inlet 316 in the form of a plurality of perforations at a first end 318 of the handle portion 308.

The head portion 310 is generally cylindrical and hollow in form, and is disposed at a second end 320 of the handle portion 308, with a central axis of the head portion 310 orthogonal to a central axis of the handle portion 308 such that the handle unit 302 is generally T-shaped in form. The head portion 310 houses the heater 314. The head portion 310 comprises a bore 322 through which air is entrained, and an air outlet 324. The air outlet 324 is generally annular in form about a periphery of the bore 322.

Figure 14:
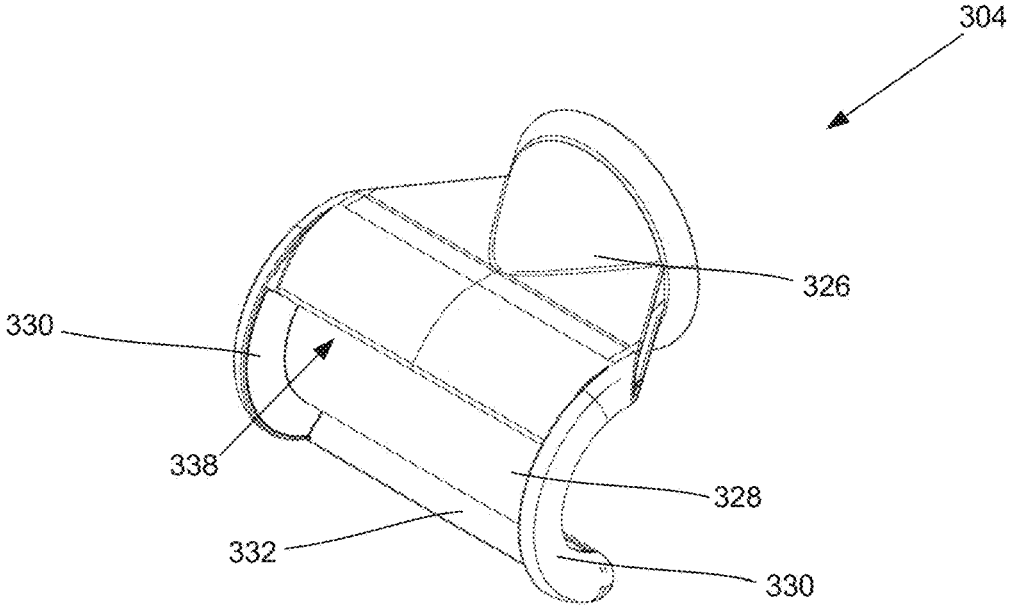
FIG. 14 is a schematic perspective view of an attachment for the haircare appliance of FIG. 12.
Figure 15:
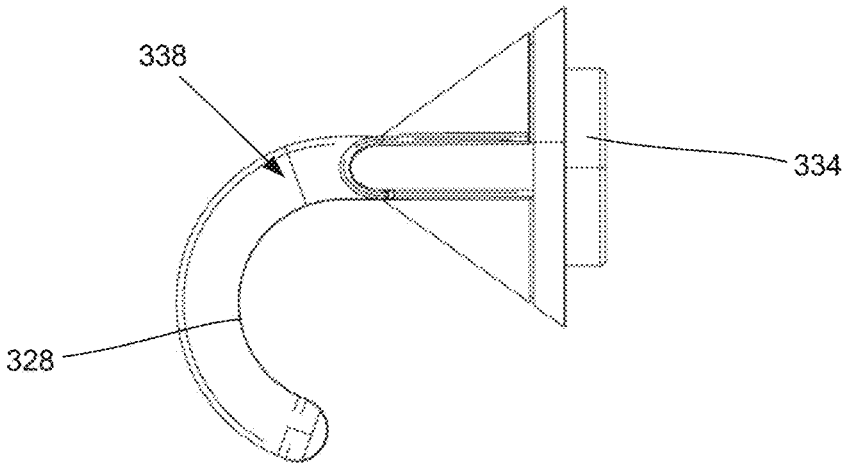
FIG. 15 is a schematic cross-sectional view through the attachment of FIG. 13.

The attachment 304 is illustrated schematically in FIGS. 14 and 15.

The attachment 304 comprises an inlet body 326, a curved surface 328, guide walls 330 and an end wall 332. The inlet body 326 is generally hollow in form, and comprises a rearwardly extending projection 334 for insertion into the bore 322, and an annular inlet 336 extending about the rearwardly extending projection 334. The inlet body 326 acts as a plenum for receiving airflow from the air outlet 324 of the handle unit 302. The inlet body 306 comprises an air outlet 338 which takes the form of a slot that has a height that varies along its width, with a peak in height at a central point of the width. The air outlet 338 has a width in the region of 81 mm and a height that varies from a minimum of 3 mm to a maximum of 4 mm. The air outlet 338 has an overall open cross-sectional area in the region of 292.7 $mm^2$.

The curved surface 328 extends outwardly from the inlet body 326 in a region of the air outlet 338. Thus the curved surface 328 is located adjacent to, and downstream of, the air outlet 338. The curved surface 328 is substantially smooth and uninterrupted in form, such that no projections, recesses or apertures are formed thereon. This may enhance the functionality of the attachment 100 which will be described hereafter. The curved surface 328 has a radius of curvature in the region of 20 mm, and has an arc angle in the region of 110 degrees. The inventors of the present application have found that such a geometry of the curved surface 328 may provide advantageous effects, as will be described hereafter.

The guide walls 330 are disposed on opposing edges of the curved surface 328. The guide walls 330 are upstanding from the curved surface 328, and extend along the full arc length of the curved surface 328. The guide walls 328 have a height substantially corresponding to a height of the air outlet 338, and have a constant height along their length. The end wall 332 is located at an end of the curved surface 328 remote from the air outlet 338, and extends between the guide walls 330. The end wall 332 prevents airflow from travelling toward the handle portion 308 of the handle unit 302 when the attachment 304 is attached to the handle unit 302 in use.

In use, the attachment 304 is attached to the handle unit 302. The airflow generator 312 generates an airflow from the air inlet 316 of the handle unit 302 to the air outlet 324 of the handle unit 302, such that airflow passes from the air outlet 324 of the handle unit 302 to the air inlet 336 of the attachment 304. Airflow flows from the air inlet 336 of the attachment through the inlet body 326 toward the air outlet 338. Airflow exits the attachment 304 via the air outlet 338 and passes over the curved surface 328.

The inventors of the present application have found that airflow attaches to the curved surface 328 via the Coanda effect. When a tress of hair is brought into the vicinity of the attachment 304, long hairs of the tress are attracted to, and at least partially wrapped about, the curved surface 328, as a result of a negative pressure region generated by the airflow over the curved surface 328. However, the pressure gradient across the tress also results in a force which causes some airflow to pass directly through the tress. Due to the location of this force relative to the curved surface 328 and the rest of the tress, shorter hairs are only held loosely at this point compared to longer hairs which are held in place on the curved surface 328. The shorter hairs are blown through the tress toward a user's head, whilst the longer hairs remain in place on the outside of the tress, ie the portion of the tress facing away from the user's head. This provides a smooth finish for hair following interaction with the haircare appliance 300 and associated attachment 100.

This effect can be optimised by appropriate modification of the geometries and parameters described herein. One such parameter that may provide increased effectiveness is the velocity of airflow at the air outlet 338 of the attachment 304. In particular, too great a velocity may result in shorter hairs sticking to the curved surface 328 and hence not being pushed away through longer hairs, whilst too low a velocity may not be sufficient to attract longer hairs to the curved surface 328 in the first instance. The applicant has determined that a velocity in the region of 30 m/s to 45 m/s may be particularly effective in generating an airflow along the curved surface 328 that results in a first force that is sufficient to attract relatively long hair toward the curved surface 328 whilst also generating a second force to push relatively short hair away from the curved surface 328. In a presently preferred embodiment, the velocity of airflow at the air outlet 338 is in the region of 43 m/s.

Another parameter that may provide increased efficacy for smoothing hair in the manner described above is a ratio of the velocity of airflow at the air outlet 338 to a flow rate of airflow generated by the airflow generator 312. In the embodiment of FIGS. 12 to 15, the ratio is in the region of 2.14-5.63, and in a particularly preferred embodiment the ratio is in the region of 3.14. The applicant has found that such a ratio may be particularly effective in generating an airflow along the curved surface 328 that results in a first force that is sufficient to attract relatively long hair toward the curved surface 328, whilst also generating a second force to push relatively short hair away from the curved surface 328.

Another parameter that may provide increased efficacy for smoothing hair in the manner described above is a ratio of flow rate of airflow generated by the airflow generator 312 to an open cross-sectional area of the air outlet 338. In the embodiment of FIGS. 12 to 15, the ratio is in the region of 0.01 to 0.10, and in a particularly preferred embodiment the ratio is in the region of 0.04. The applicant has found that such a ratio may be particularly effective in generating an airflow along the curved surface 328 that results in a first force that is sufficient to attract relatively long hair toward the curved surface 328, whilst also generating a second force to push relatively short hair away from the curved surface 328.

Figure 13:
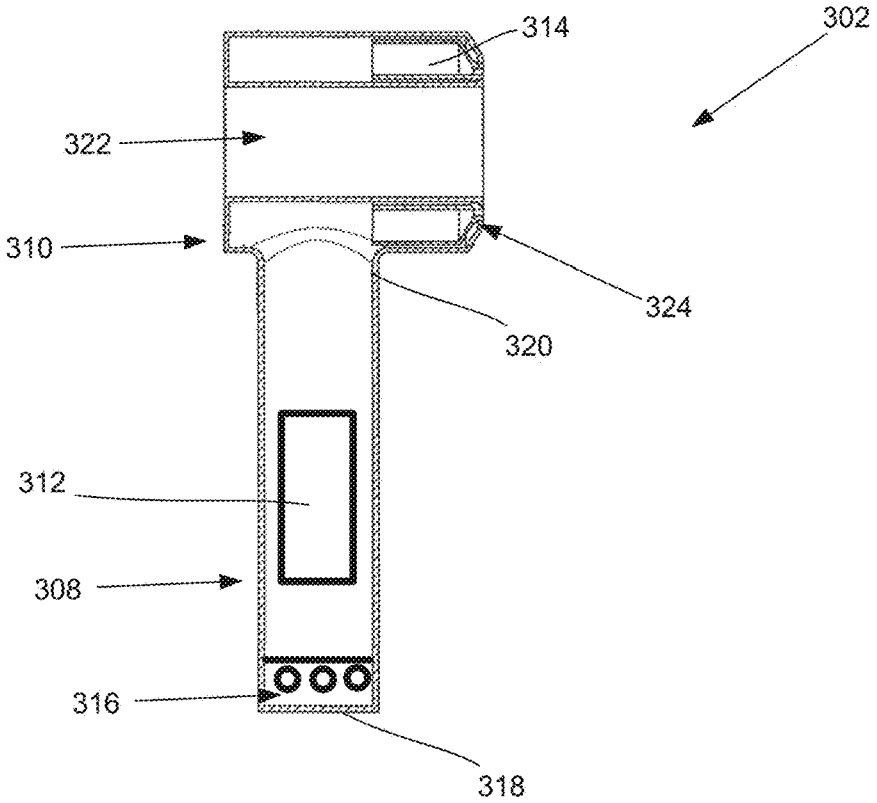
FIG. 13 is a schematic cross-sectional view through a handle unit of the haircare appliance of FIG. 12.

A further parameter that may provide increased efficacy for smoothing hair in the manner described above is a ratio of a radius of curvature of the curved surface 328 to the velocity of airflow at the air outlet 338. In the embodiment of FIGS. 13 to 15, the ratio is in the region of 0.33 to 2.00, and in a particularly preferred embodiment the ratio is in the region of 0.47. The applicant has found that such a ratio may be particularly effective in generating an airflow along the curved surface 328 that results in a first force that is sufficient to attract relatively long hair toward the curved surface 328, whilst also generating a second force to push relatively short hair away from the curved surface 328.

Another parameter that may provide increased efficacy for smoothing hair in the manner described above is a ratio of a radius of curvature of the curved surface 328 to an arc length of the curved surface 328. In the embodiment of FIGS. 12 to 15, the ratio is in the region of 0.04 to 0.63, and in a particularly preferred embodiment the ratio is in the region of 0.18. The applicant has found that such a ratio may be particularly effective in generating an airflow along the curved surface 328 that results in a first force that is sufficient to attract relatively long hair toward the curved surface 328, whilst also generating a second force to push relatively short hair away from the curved surface 328.

The guide walls 330 extend along opposing edges of the curved surface 328. This effectively creates an airflow channel, with the guide walls 330 acting as walls of the channel, and the curved surface 210 acting as a bed of the channel. The guide walls 330 inhibit ambient air from interacting with airflow flowing along the curved surface 328 in use, which may maintain the negative pressure region created by airflow flowing along the curved surface 328.

Although described herein as embodiment with releasable attachments, embodiments are also envisaged where, rather than the haircare appliance comprising a handle unit and an attachment the haircare appliance is a single-piece unit, for example taking the form of the combined handle unit and attachment previously described.

The invention claimed is:

1. A haircare appliance comprising:

a hollow body comprising an air inlet and an air outlet, an airflow generator for generating an airflow from the air inlet to the air outlet, a convex curved surface adjacent to and downstream of the air outlet, and a pair of guide walls for guiding the airflow along the convex curved surface, the pair of guide walls extending outwardly from the convex curved surface, wherein a first edge of the convex curved surface is attached to the hollow body adjacent to the air outlet, and wherein a second edge of the convex curved surface is a free edge such that the convex curved surface is cantilevered relative to the hollow body.

2. The haircare appliance according to claim 1, wherein the pair of guide walls extend along substantially an entire length of the convex curved surface.

3. The haircare appliance according to claim 1, wherein the pair of guide walls comprise a height substantially equal to a height of the air outlet in a region adjacent to the air outlet.

4. The haircare appliance according to claim 1, wherein the pair of guide walls comprise a radius of curvature greater than a radius of curvature of the convex curved surface.

5. The haircare appliance according to claim 1, wherein the pair of guide walls comprise a radius of curvature greater than a radius of curvature of the convex curved surface in a region adjacent to the air outlet.

6. The haircare appliance according to claim 1, wherein the pair of guide walls comprise a height that varies along a length of the pair of guide walls.

7. The haircare appliance according to claim 1, wherein the pair of guide walls comprise a constant height.

8. The haircare appliance according to claim 1, wherein the haircare appliance is configured such that the airflow exiting the air outlet generates a first force to attract hair toward the convex curved surface, and a second force to push hair away from the convex curved surface.

9. The haircare appliance according to claim 1, wherein the haircare appliance comprises a handle unit within which the airflow generator is housed, and an attachment releasably attachable to the handle unit, the attachment comprising the air outlet, the convex curved surface and the guide walls.

10. The haircare appliance according to claim 1, further comprising an end wall arranged at an end of the convex curved surface remote from the air outlet.

11. The haircare appliance according to claim 10, wherein the end wall extends between the pair of guide walls.

12. An attachment for a haircare appliance comprising an air inlet, an air outlet for emitting airflow, a convex curved surface adjacent to and downstream of the air outlet, and a pair of guide walls for guiding the airflow along the convex curved surface, the pair of guide walls extending outwardly from the convex curved surface, wherein the pair of guide walls and the convex curved surface are integrally formed as a single component.

13. The attachment according to claim 12, wherein the pair of guide walls extend along substantially an entire length of the convex curved surface.

14. The attachment according to claim 12, wherein the pair of guide walls comprise a height substantially equal to a height of the air outlet.

15. The attachment according to claim 12, wherein the pair of guide walls comprise a height substantially equal to a height of the air outlet in a region adjacent to the air outlet.

16. The attachment according to claim 12, wherein the pair of guide walls comprise a radius of curvature greater than a radius of curvature of the convex curved surface.

17. The attachment according to claim 12, wherein the pair of guide walls comprise a radius of curvature greater than a radius of curvature of the convex curved surface in a region adjacent to the air outlet.

18. The attachment according to claim 12, wherein the pair of guide walls comprise a height that varies along a length of the pair of guide walls.

19. The attachment according to claim 12, wherein the pair of guide walls comprise a constant height.

20. The attachment according to claim 12, wherein the haircare appliance is configured such that the airflow exiting the air outlet generates a first force to attract hair toward the convex curved surface, and a second force to push hair away from the convex curved surface.

21. An attachment for a haircare appliance comprising an air inlet, an air outlet for emitting airflow, a convex curved surface adjacent to and downstream of the air outlet, and a pair of guide walls for guiding the airflow along the convex curved surface, wherein the pair of guide walls extend outwardly from the convex curved surface, and wherein the pair of guide walls comprise a constant height.

* * * * *